US008364472B2

(12) United States Patent
Ehara

(10) Patent No.: US 8,364,472 B2
(45) Date of Patent: Jan. 29, 2013

(54) VOICE ENCODING DEVICE AND VOICE ENCODING METHOD

(75) Inventor: Hiroyuki Ehara, Kangawa (JP)

(73) Assignee: Panasonic Corporation, Osaka (JP)

( * ) Notice: Subject to any disclaimer, the term of this patent is extended or adjusted under 35 U.S.C. 154(b) by 722 days.

(21) Appl. No.: 12/528,880

(22) PCT Filed: Feb. 29, 2008

(86) PCT No.: PCT/JP2008/000407
§ 371 (c)(1),
(2), (4) Date: Aug. 27, 2009

(87) PCT Pub. No.: WO2008/108083
PCT Pub. Date: Sep. 12, 2008

(65) Prior Publication Data

US 2010/0106488 A1 Apr. 29, 2010

(30) Foreign Application Priority Data

Mar. 2, 2007 (JP) ..... 2007-053530

(51) Int. Cl.
*G10L 11/04* (2006.01)

(52) U.S. Cl. ..... 704/207; 704/200.1; 704/211; 704/219; 704/220; 704/223; 704/230; 704/233; 704/258; 704/262; 381/93; 700/94

(58) Field of Classification Search ..... 704/219, 704/200.1, 211, 220, 223, 230, 233, 258, 704/262; 381/93; 700/94; 375/240.7
See application file for complete search history.

(56) References Cited

U.S. PATENT DOCUMENTS 5,265,190 A * 11/1993 Yip et al. ..... 704/219
5,633,980 A * 5/1997 Ozawa ..... 704/200.1
(Continued)

FOREIGN PATENT DOCUMENTS

JP 2003-533916 11/2003
JP 2004-102074 4/2004
(Continued)

OTHER PUBLICATIONS

English language Abstract of JP 2005-513539, May 12, 2005.
(Continued)

*Primary Examiner* — Michael Colucci
(74) *Attorney, Agent, or Firm* — Greenblum & Bernstein, P.L.C.

(57) ABSTRACT

Provided is an audio encoding device which can detect an optimal pitch pulse when using pitch pulse information as redundant information. The device includes: a search start decision unit (121) which decides the oldest point among a plurality of points where a pitch pulse may exist; a pitch pulse candidate selection unit (122) which defines a search range as a range between the search start point and the point preceding the point of the head of the current frame by one and selects a decoding sound source vector having a large amplitude in this search range as a pitch pulse position candidate; a selector switch (125) which successively switches a plurality of pitch pulse position candidates inputted from a pitch pulse candidate selection unit (122) for output to a pulse sequence generation unit (123) and an error minimization unit (124); a pulse sequence generation unit (123) which generates as a pulse sequence, a vector generated as an adaptive codebook component from the pitch pulse in the current frame when a pitch pulse is set to be a pitch pulse position candidate inputted from the selector switch (125).

8 Claims, 8 Drawing Sheets

U.S. PATENT DOCUMENTS

| | | | | |
|---|---|---|---|---|
| 5,704,003 | A * | 12/1997 | Kleijn et al. | 704/220 |
| 5,828,811 | A * | 10/1998 | Taniguchi et al. | 704/220 |
| 6,041,298 | A * | 3/2000 | Gortz | 704/223 |
| 6,141,638 | A * | 10/2000 | Peng et al. | 704/211 |
| 6,385,576 | B2 * | 5/2002 | Amada et al. | 704/223 |
| 6,757,654 | B1 * | 6/2004 | Westerlund et al. | 704/262 |
| 6,928,406 | B1 * | 8/2005 | Ehara et al. | 704/223 |
| 2001/0034600 | A1 * | 10/2001 | Yasunaga et al. | 704/219 |
| 2002/0173951 | A1 * | 11/2002 | Ehara | 704/219 |
| 2004/0093205 | A1 * | 5/2004 | Ashley et al. | 704/220 |
| 2004/0158463 | A1 * | 8/2004 | Jabri et al. | 704/219 |
| 2005/0071153 | A1 * | 3/2005 | Tammi et al. | 704/219 |
| 2005/0154584 | A1 * | 7/2005 | Jelinek et al. | 704/219 |
| 2006/0089833 | A1 * | 4/2006 | Su et al. | 704/230 |
| 2007/0071116 | A1 | 3/2007 | Oshikiri et al. | |
| 2008/0255833 | A1 * | 10/2008 | Goto et al. | 704/219 |
| 2009/0055169 | A1 | 2/2009 | Goto et al. | |
| 2010/0049508 | A1 * | 2/2010 | Morii | 704/219 |
| 2010/0106492 | A1 * | 4/2010 | Sato et al. | 704/219 |

FOREIGN PATENT DOCUMENTS

| | | |
|---|---|---|
| JP | 2005-513539 | 5/2005 |
| JP | 2005-534950 | 11/2005 |
| WO | 01/86637 | 11/2001 |
| WO | 03/102921 | 12/2003 |
| WO | 2005/040749 | 5/2005 |

OTHER PUBLICATIONS

English language Abstract of JP 2003-533916, Nov. 11, 2003.
English language Abstract of JP 2004-102074, Apr. 2, 2004.
English language Abstract of JP 2005-534950, Nov. 17, 2005.
U.S. Appl. No. 12/529,212 to Oshikiri, filed Aug. 31, 2009.
U.S. Appl. No. 12/528,661 to Sato et al, filed Aug. 26, 2009.
U.S. Appl. No. 12/528,671 to Kawashima et al, filed Aug. 26, 2009.
U.S. Appl. No. 12/528,869 to Oshikiri et al, filed Aug. 27, 2009.
U.S. Appl. No. 12/528,877 to Morii et al, filed Aug. 27, 2009.
U.S. Appl. No. 12/529,219 to Morii et al, filed Aug. 31, 2009.
U.S. Appl. No. 12/528,871 to Morii et al, filed Aug. 27, 2009.
U.S. Appl. No. 12/528,659 to Oshikiri et al, filed Aug. 26, 2009.
U.S. Appl. No. 12/528,878 to Ehara, filed Aug. 27, 2009.
ITU-T Recommendation G. 729.1, pp. 1-91, 2006.

* cited by examiner

VOICE ENCODING DEVICE AND VOICE ENCODING METHOD

TECHNICAL FIELD

The present invention relates to a speech encoding apparatus and speech encoding method.

BACKGROUND ART

A speech codec for Voice over IP (VoIP) is required high robustness against packet loss. It is demanded that a next-generation VoIP codec achieves error-free quality even at a comparatively high frame erasure rate (e.g. 6%) (when redundant information to conceal for erasure error is allowed to transmit).

In the case of Code excited linear prediction (CELP) speech codec, there are many cases where quality degradation due to frame erasure in the speech onset portion becomes a problem. One reason for this is that a signal in the onset portion varies greatly and has low correlation with the signal of the previous frame, and therefore concealment processing using information about the previous frame does not function effectively. Another reason is that, in a subsequent frame of the voiced portion, an excitation signal encoded in the onset portion is highly used as an adaptive codebook, and therefore the influence of the erasure in the onset portion continues to a subsequent voiced frame, which is likely to cause major distortion of a decoded speech signal.

As a conventional technique to solve the above-noted problems, there is a technique of transmitting the last glottal pulse position in the previous frame and encoded information of the current frame together (e.g. see Non-Patent Document 1). In this technique, a speech encoding apparatus detects the pulse position of the highest amplitude in the range of the past one pitch period including the frame end of the excitation signal (i.e. linear prediction residual signal) in the previous frame, as a glottal pulse position, encodes the position information and transmits the result and encoded information of the current frame to the speech decoding apparatus. When a decoded frame is erased, the speech decoding apparatus generates a decoded speech signal by allocating a glottal pulse to the glottal pulse position received as input from the speech encoding apparatus in the next frame.

Non-Patent Document 1: ITU-T Recommendation G.729.1

DISCLOSURE OF INVENTION

Problems to be Solved by the Invention

However, when the pitch period is not accurate (e.g. when the pitch period is a double pitch period or half pitch period), the above-described conventional technique may not detect the correct glottal pulse position. Further, when there is no distinct glottal pulse in an excitation signal (e.g. when a plurality of pulses compete), the pulse position of the highest amplitude may not be optimum as a glottal pulse position in an excitation signal subjected to low pass filter processing.

It is therefore an object of the present invention to provide a speech encoding apparatus and speech encoding method that can detect an optimal pitch pulse when pitch pulse information is used as redundant information for erasure concealment processing.

Means for Solving the Problem

The speech encoding apparatus of the present invention using pitch pulse information as redundant information for erasure concealment processing, employs a configuration having: a determining section that determines a search range of a pitch pulse position of a previous frame, using a pitch period in a current frame; a selecting section that selects a plurality of candidates of the pitch pulse position using an excitation signal of the previous frame; a generating section that generates an adaptive codebook component of an excitation signal in the current frame using the plurality of candidates; and an error minimizing section that acquires a definitive pitch pulse position in the previous frame to minimize an error between a vector of the adaptive codebook component and a decoded excitation vector.

Advantageous Effects of Invention

According to the present invention, when pitch pulse information is used as redundant information for erasure concealment processing, it is possible to detect an optimal pitch pulse.

BEST MODE FOR CARRYING OUT THE INVENTION

Figure 1:
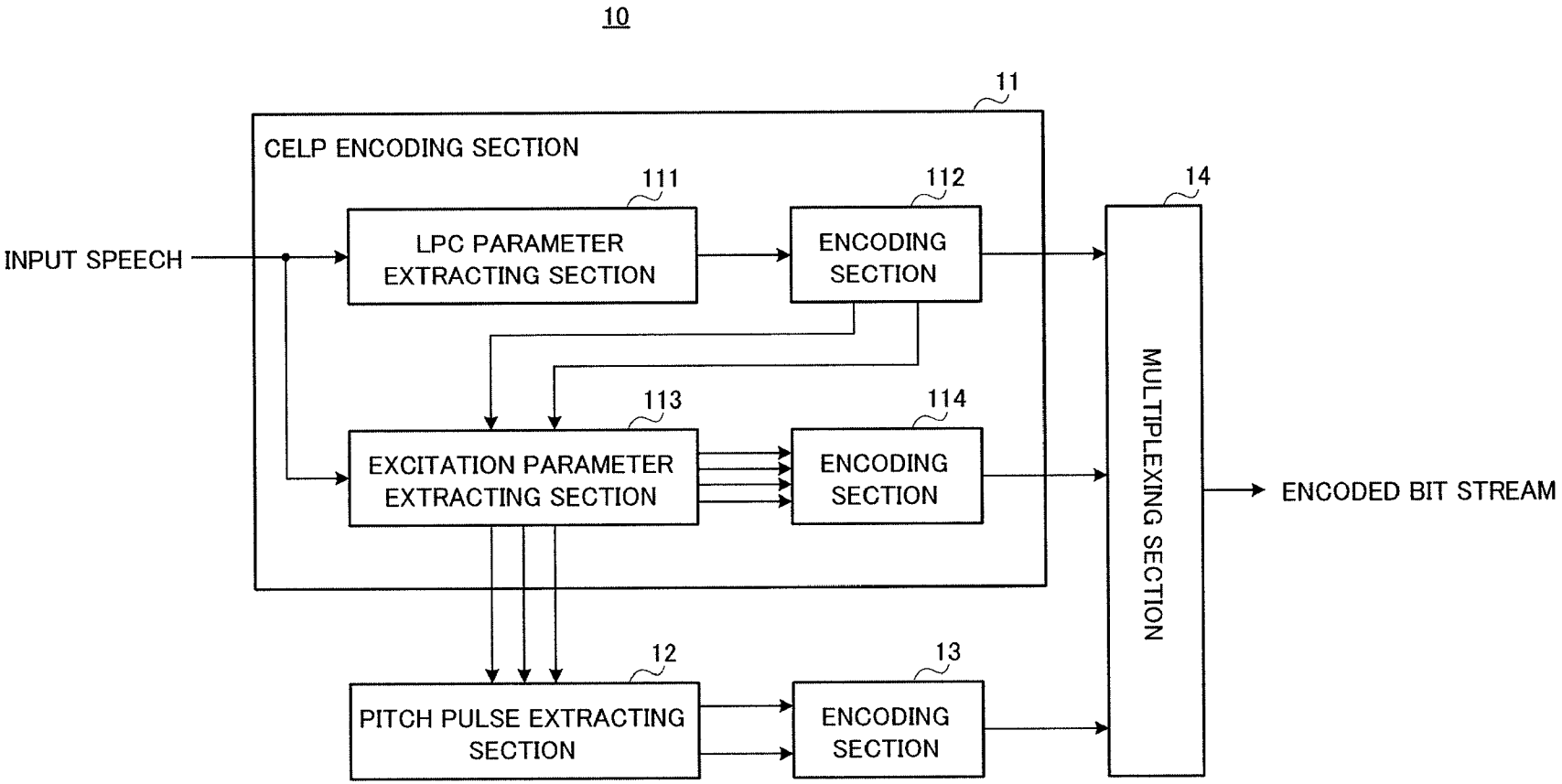
FIG. 1 is a block diagram showing the configuration of a speech encoding apparatus according to an embodiment of the present invention.

With the present invention, upon transmitting position information of the pitch pulse of an excitation signal in the previous frame (which corresponds to a glottal pulse position of the above-described conventional technique and which is a sample in which an amplitude of an excitation signal is maximum among one pitch period length) as encoded information for frame erasure concealment processing, the pitch pulse position at the tail end of the previous frame is searched for using both the excitation signal of the previous frame and the excitation signal of the current frame, to detect an optimal pitch pulse position.

Further, the present invention searches for a pitch pulse position such that not only the excitation signal of the previous frame but also the excitation signal generated as the adaptive codebook component in the current frame, are close to an error-free excitation signal. That is, since the excitation signal encoded in the onset portion is actively used in a frame of the subsequent voiced portion as an adaptive codebook, a search is performed taking into account that the influence of the erasure in the onset portion continues to the subsequent voiced frame, in the present invention. By this means, the present invention generates a pulse sequence vector by simulating decoding processing of an excitation signal implemented in the subsequent frame, and determines a pitch pulse position so as to minimize decoding error between the pulse sequence vector and an error-free decoded excitation vector.

Further, generating the adaptive codebook component of an excitation vector by applying a long-term prediction filter (e.g. pitch prediction filter) to an adaptive codebook causes high computational complexity, and, consequently, the present invention generates a pulse vector in a simple manner by using a pitch pulse position and a pitch lag in the subsequent frame, thereby reducing the amount of calculations.

Further, the present invention performs a search for a pitch pulse position with respect to a plurality of position candidates preliminary selected in the previous frame (corresponding to an erased frame). That is, the present invention performs a preliminary selection based on error in the previous frame and performs the actual selection (i.e. search of a pitch pulse position) based on error in the current frame (corresponding to the frame following the erased frame).

An embodiment of the present invention will be explained below in detail with reference to the accompanying drawings.

The speech encoding apparatus of the present invention is designed to transmit, as one encoded data, encoded information of the current frame (n) and encoded information of the frame one frame before the current frame, that is, encoded information of the previous frame (n−1). Further, the speech encoding apparatus of the present invention efficiently and accurately searches for the temporally last pitch pulse among a plurality of pitch pulses that exist in the excitation signal of the previous frame (n−1).

FIG. 1 illustrates the configuration of speech encoding apparatus 10 according to the present embodiment. Here, CELP encoding section 11 is formed with LPC (Linear Prediction Coefficient) parameter extracting section 111, encoding section 112, excitation parameter extracting section 113 and encoding section 114.

In speech encoding apparatus 10, CELP encoding section 11 encodes the information of the current frame (n), and pitch pulse extracting section 12 and encoding section 13 encode the information of the previous frame (n−1). Speech encoding apparatus 10 transmits the information of the previous frame (n−1) as redundant information with the information of the current frame (n), so that the speech decoding apparatus decodes the information of the previous frame (n−1) included in the current encoded data, even if the encoded data previous to the current encoded data is erased, thereby suppressing the quality degradation of decoded speech signals. For the redundant information, the position and amplitude of the temporally last pitch pulse among a plurality of pitch pulses that exist in the excitation signal of the previous frame (n−1), that is, the position and amplitude of the pitch pulse in the nearest position to the current frame (n), are used.

In speech encoding apparatus 10, LPC parameter extracting section 111 and excitation parameter extracting section 113 receive as input an input speech signal.

LPC parameter extracting section 111 extracts the LPC parameters on a per frame basis and outputs them to encoding section 112. Here, the LPC parameters may be in the form of LSP's (Line Spectrum Pairs or Line Spectral Pairs) or LSF's (Line Spectrum Frequencies or Line Spectral Frequencies).

Encoding section 112 quantizes and encodes the LPC parameters, outputs un-quantized LPC parameters and quantized LPC parameters to excitation parameter extracting section 113 and outputs the encoded result (i.e. LPC code) to multiplexing section 14.

Excitation parameter extracting section 113 determines the excitation parameters to minimize the error between a perceptually weighted input speech signal and a perceptually weighted synthesis speech signal, using the input speech signal, un-quantized LPC parameters and quantized LPC parameters, and outputs the excitation parameters to encoding section 114. In general CELP encoding, excitation parameters are formed with four parameters: a pitch lag, a fixed codebook index, a pitch gain and a fixed codebook gain. Further, excitation parameter extracting section 113 outputs the pitch period, the pitch gain and the decoded excitation vector, to pitch pulse extracting section 12.

Encoding section 114 encodes the excitation parameters and outputs the encoded results (i.e. excitation code) to multiplexing section 14.

Pitch pulse extracting section 12 searches for a pitch pulse using the pitch period, pitch gain and decoded excitation vector, and outputs the position and amplitude of the pitch pulse to encoding section 13. Pitch pulse extracting section 12 will be described below in detail.

Encoding section 13 encodes the position and amplitude of the pitch pulse and outputs the encoded result (i.e. pitch pulse code) to multiplexing section 14.

Multiplexing section 14 generates an encoded bit stream by multiplexing the LPC code, excitation code and pitch pulse code, and outputs this encoded bit stream to the transmission channel.

Figure 2:
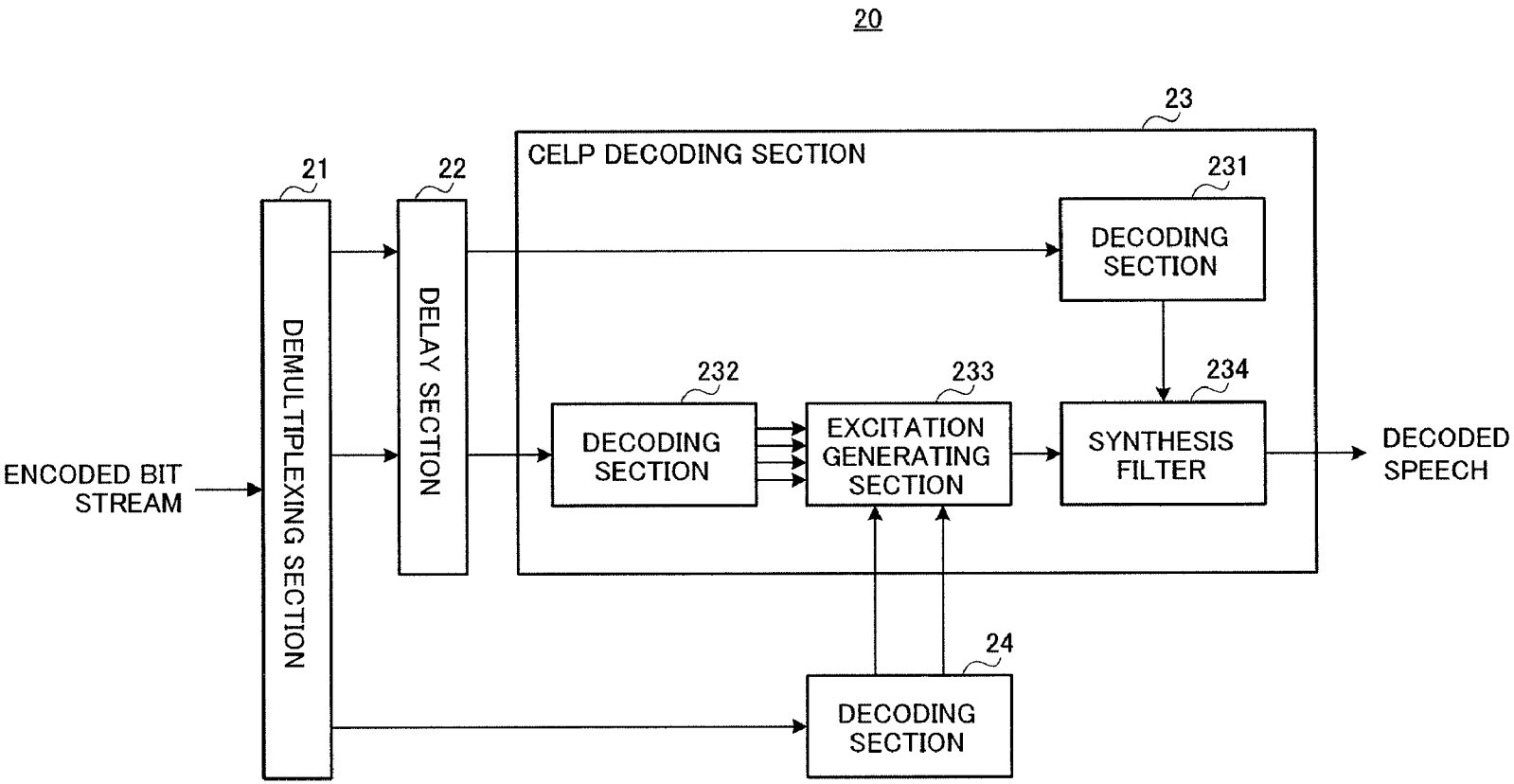
FIG. 2 is a block diagram showing the configuration of a speech decoding apparatus according to an embodiment of the present invention.

FIG. 2 illustrates the configuration of speech decoding apparatus 20 according to the present embodiment. Here, CELP decoding section 23 is formed with decoding section 231, decoding section 232, excitation generating section 233 and synthesis filter 234.

In speech decoding apparatus 20, demultiplexing section 21 receives as input the encoded bit stream transmitted from speech encoding apparatus 10 (in FIG. 1).

Demultiplexing section 21 demultiplexes the encoded bit stream into the LPC code, excitation code and pitch pulse code, outputs the LPC code and the excitation code to delay section 22 and outputs the pitch pulse code to decoding section 24.

Delay section 22 outputs the LPC code with a delay of one-frame time to decoding section 231 and outputs the excitation code with a delay of one-frame time to decoding section 232.

Decoding section 231 decodes the LPC code received as input from delay section 22, that is, the LPC code of the previous frame, and outputs the decoded result (i.e. LPC parameters) to synthesis filter 234.

Decoding section 232 decodes the excitation code received as input from delay section 22, that is, the excitation code of the previous frame, and outputs the decoded result (i.e. excitation parameters) to excitation generating section 233. As described above, the excitation parameters are formed with four parameters: a pitch lag, a fixed codebook index, a pitch gain and a fixed codebook gain.

Decoding section 24 decodes the pitch pulse code and outputs the decoded result (i.e. the position and amplitude of the pitch pulse) to excitation generating section 233.

Excitation generating section 233 generates an excitation signal from the excitation parameters and outputs this excitation signal to synthesis filter 234. However, if the previous frame is erased, excitation generating section 233 generates an excitation signal by placing a pitch pulse according to the position and amplitude of the pitch pulse, and outputs this excitation signal to synthesis filter 234. Here, when the current frame is also erased, excitation generating section 233 generates an excitation signal by utilizing, for example, the frame erasure concealment processing disclosed in ITU-T recommendation G.729 (e.g. repeatedly using the decoded parameters of the previous frame), and outputs this excitation signal to synthesis filter 234.

Synthesis filter 234 is formed using the LPC parameters received as input from decoding section 231, and synthesizes a decoded speech signal using the excitation signal received as input from excitation generating section 233, as a drive signal.

Figure 3:
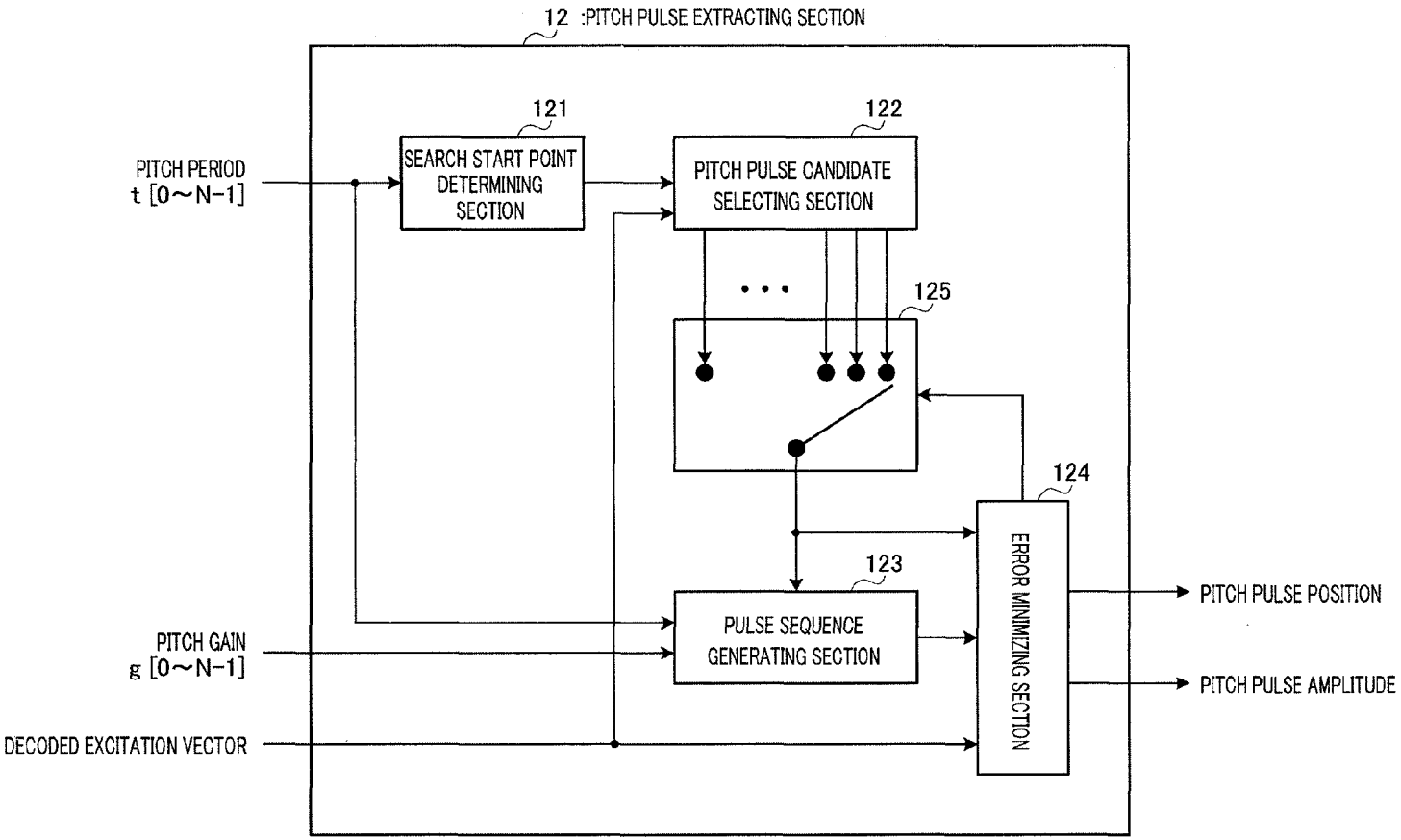
FIG. 3 is a block diagram showing the configuration of a pitch pulse extracting section according to an embodiment of the present invention.

Next, pitch pulse extracting section 12 will be explained in detail. FIG. 3 illustrates the configuration of pitch pulse extracting section 12 according to the present embodiment.

In pitch pulse extracting section 12, search start point determining section 121 and pulse sequence generating section 123 receive as input pitch period t[0~N−1], pulse sequence generating section 123 receives as input pitch gain g[0~N−1], and pitch pulse candidate selecting section 122 and error minimizing section 124 receive as input a decoded excitation signal. Here, this decoded excitation vector is an error-free excitation vector.

Here, pitch period t[0] represents the pitch period of the first subframe in the current frame, pitch period t[1] represents the pitch period of the second subframe in the current frame, . . . , and pitch period t[N−1] represents the pitch period of the N-th subframe (i.e. the last subframe) in the current frame. Similarly, pitch gain g[0] represents the pitch gain of the first subframe in the current frame, pitch gain g[1] represents the pitch gain of the second subframe in the current frame, . . . , and pitch gain g[N−1] represents the pitch gain of the N-th subframe (i.e. the last subframe) in the current frame. Also, when the first sample of the current frame is ex[0], the decoded excitation vector is an excitation vector at least in the range of ex[−t_max] to ex[1_frame−1]. Here, t_max represents the maximum value of the pitch period, and 1_frame represents the frame length. That is, in the present embodiment, an error-free excitation vector combining a past excitation vector of the maximum pitch period length from the tail end of the previous frame, and an excitation vector of one frame in the current frame, is used for pitch pulse search. Also, it is possible to employ a configuration in which excitation parameter extracting section 113 has a buffer and in which those excitation vectors are all received as input from excitation parameter extracting section 113, or it is possible to employ a configuration in which pitch pulse extracting section 12 has a buffer, in which a decoded excitation vector of the current frame alone is outputted from excitation parameter extracting section 113 and in which an excitation vector of the maximum pitch period length in the previous frame is sequentially stored and updated in the buffer provided in pitch pulse extracting section 12.

Search start point determining section 121 determines a pitch pulse search range. To be more specific, search start point determining section 121 determines the earliest point in a plurality of points in which a pitch pulse may exist, as the search start point. If there is only one pitch period in one frame, that is, if one frame is not divided into a plurality of subframes, this search start point corresponds to the point the pitch period of the current frame back from the head of the current frame. By contrast, if one frame is divided into a plurality of subframes that may have varying pitch periods, this search start point corresponds to the earliest point among a plurality of points the respective pitch periods in the subframes back from the heads of the subframes.

The method of determining the search start point in search start point determining section 121 will be explained in detail using FIG. 4, FIG. 5 and FIG. 6.

Figure 4:
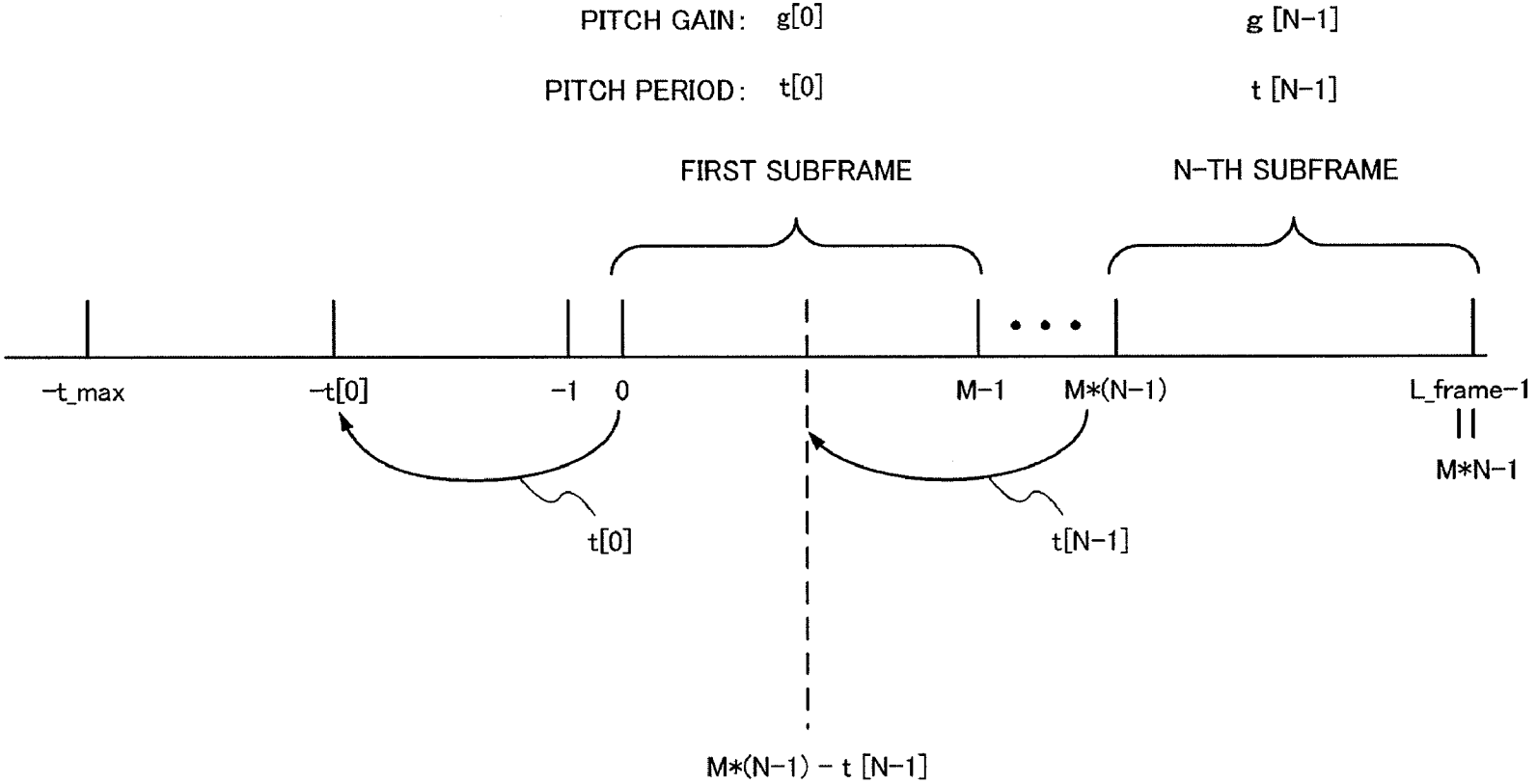
FIG. 4 is a diagram illustrating a search start point determining method according to an embodiment of the present invention.

In FIG. 4, the first candidate of a search start point (the point of −t[0]) is the first subframe pitch period t[0] back from the start point of the current frame (i.e. the start point of the first subframe (the point of 0)). Similarly, the n-th candidate of the search start point for the n-th subframe is point M*(n−1)−t[n−1]. Here, M is the subframe length (in samples). Therefore, when one frame is comprised of N subframes, the N-th candidate of the search start point for the N-th subframe is point M*(N−1)−t[N−1]. Then, the temporally earliest point among the first to N-th candidates is determined as the search start point. In the case where the variation of the pitch period in one frame is little, the first candidate is earlier when the first candidate and N-th candidate of the search start point are compared, as shown in FIG. 4. When the variation of the pitch period in one frame is little (i.e. when a double pitch period or a half pitch period does not occur), the first candidate of the search start point is earlier than any of the second to N-th candidates, and is therefore determined as the search start point.

Figure 5:
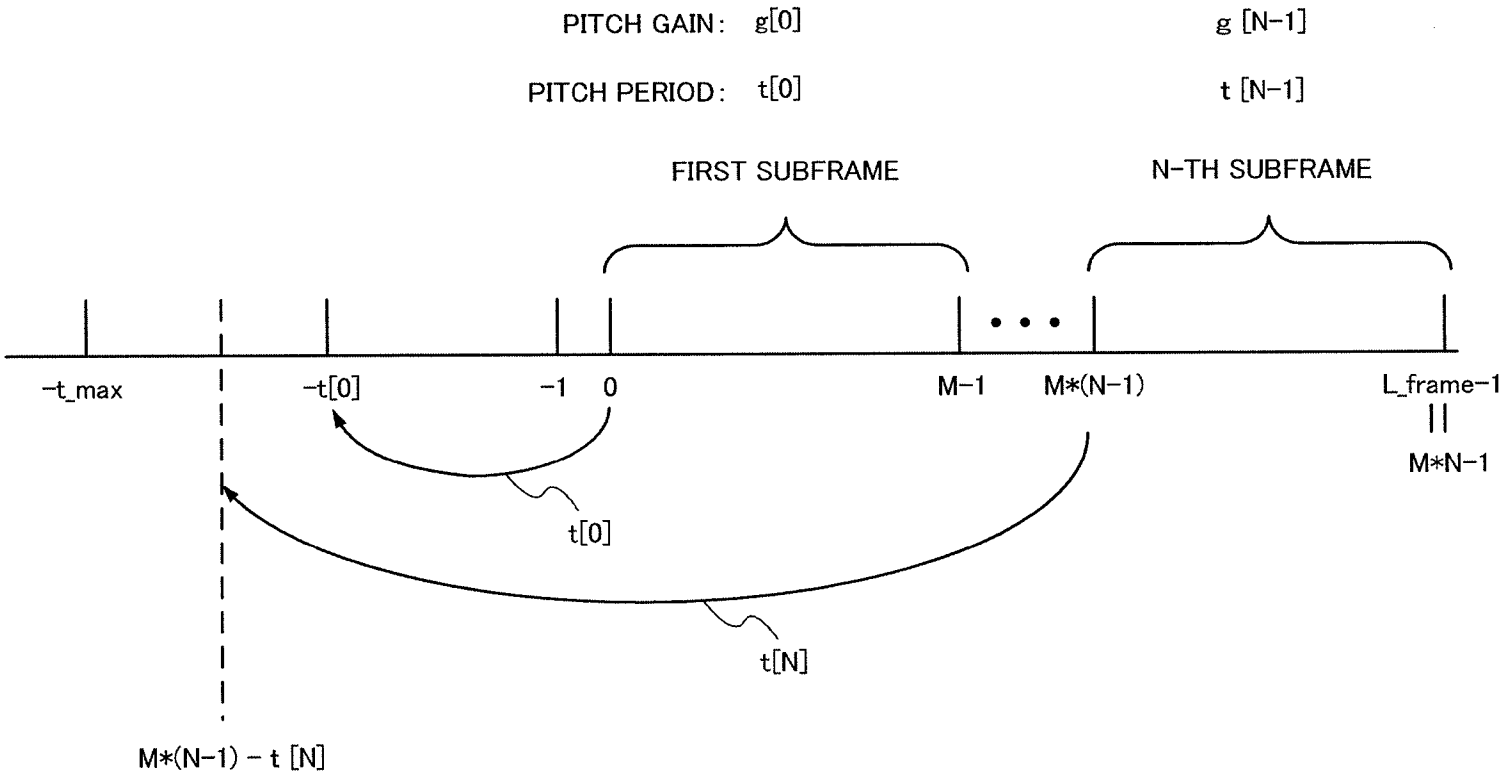
FIG. 5 is a diagram illustrating a search start point determining method according to an embodiment of the present invention.

By contrast, as shown in FIG. 5, a case is possible where the pitch period in the N-th subframe is long and the N-th candidate of a search start point is earlier than the first candidate of the search start point. In this case, the first candidate is not determined as the search start point.

Figure 6:
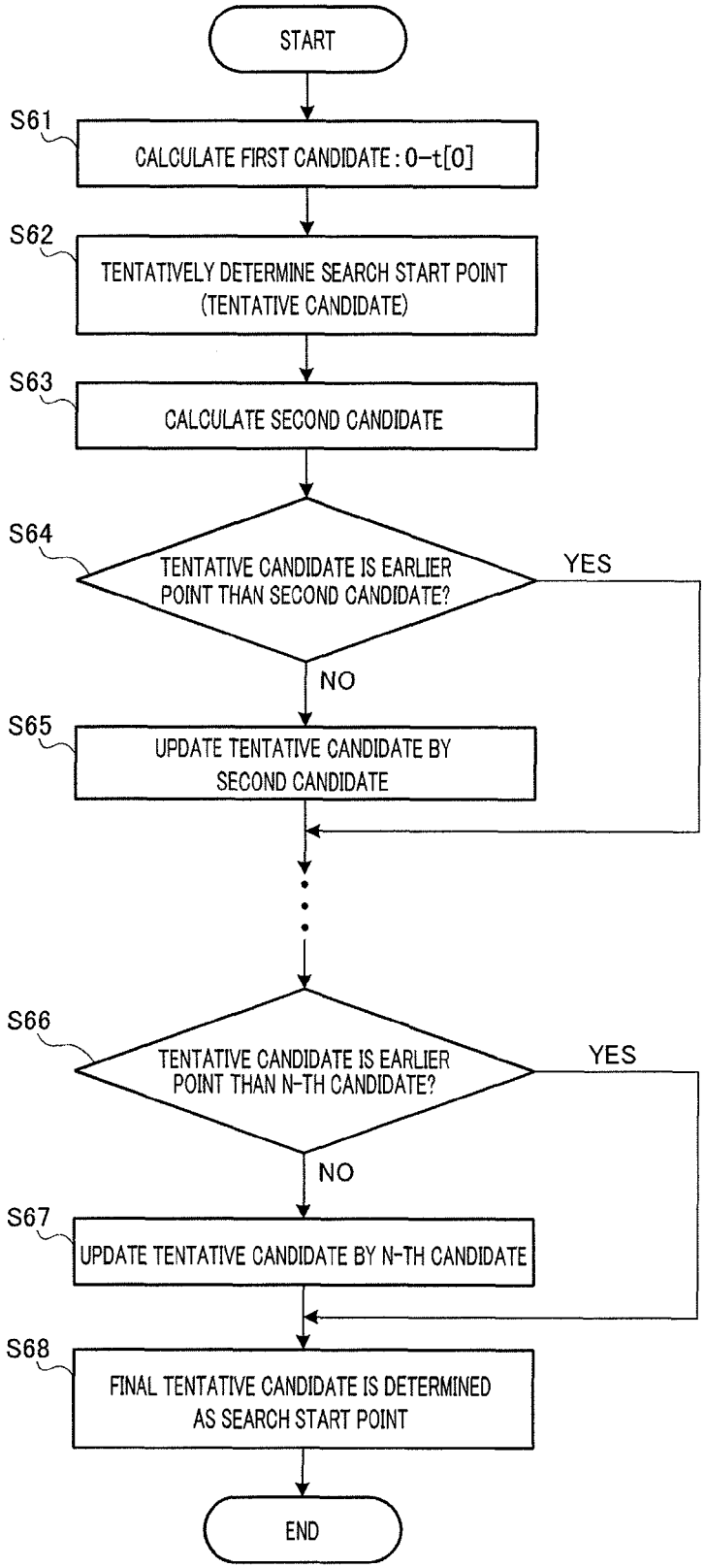
FIG. 6 is a flowchart showing the determination steps of a search start point according to an embodiment of the present invention.

Then, with the present embodiment, the search start point is determined according to the processing flow shown in FIG. 6.

First, in step S61, the first candidate (0−t[0]) of the search start point is found.

Then, in step S62, the first candidate found in step S61 is tentatively determined as the search start point. That is, the first candidate is determined as a tentative candidate.

Next, in step S63, the second candidate of the search start point is found.

Next, in step S64, the tentative candidate (i.e. the first candidate) and the second candidate are compared.

Then, if the second candidate is earlier than the tentative candidate (i.e. the first candidate), that is, if the value in the position of the second candidate is lower than the value in the position of the tentative candidate (i.e. the first candidate) (i.e. "NO" in step S64), in step S65, the tentative candidate is updated by the second candidate. That is, in this case, the second candidate becomes a new tentative candidate.

By contrast, if the tentative candidate (i.e. the first candidate) is earlier than the second candidate, that is, if the value of the position of the tentative candidate (i.e. the first candidate) is lower than the value of the position of the second candidate (i.e. "YES" in step 64), the first candidate stays as a tentative candidate.

The processing in steps S64 and S65 are repeated up to the N-th subframe (step S64 to step S67).

In step S68, the final tentative candidate is determined as the search start point.

By this processing flow, the search start point is found at the temporally earliest point among the first to N-th candidates.

Pitch pulse candidate selecting section 122 receives as input the search start point determined as above in search start point determining section 121.

Pitch pulse candidate selecting section 122 sets a search range between the search start point and the point previous to the head point of the current frame (i.e. the last or tail end point of the previous frame), and selects positions in which the amplitude of a decoded excitation vector is high, as pitch pulse position candidates. To reduce the amount of calculations in this selection processing, pitch pulse candidate selecting section 122 divides the search range into groups corresponding to the number of selected pitch pulse position candidates, detects the position of the highest amplitude in each group and outputs a plurality of detected positions as pitch pulse position candidates. Here, the plurality of groups may be comprised of consecutive points or may be comprised of sets of points at regular intervals like the algebraic codebook represented in ITU-T Recommendation G.729. When a plurality of groups are comprised of consecutive points, for example, it may be appropriate to divide the range between the search start point and the search end point (i.e. the end point of the previous frame) evenly. Also, when a plurality of groups are comprised of sets of points at regular intervals, for example, it may be appropriate to make the search start point "0," make the points of 0, 5, 10 . . . the first group, make the points of 1, 6, 11 . . . the second group, . . . , and make the points of 4, 9, 14 . . . the fifth group.

Changeover switch 125 receives as input the pitch pulse position candidates selected as above in pitch pulse candidate selecting section 122.

Changeover switch 125 sequentially switches and outputs the plurality of pitch pulses received as input from pitch pulse candidate selecting section 122, to pulse sequence generating section 123 and error minimizing section 124.

If a pitch pulse is placed in a pitch pulse position candidate received as input from changeover switch 125, pulse sequence generating section 123 generates a pulse sequence by a vector to be generated from this pitch pulse as the adaptive codebook component in the current frame. This pulse sequence can be generated by applying a long term prediction filter (e.g. pitch prediction filter) to the adaptive codebook. However, in the present embodiment, to reduce the amount of calculations, this pulse sequence is generated by placing a pulse in the position adding the pitch period to the pulse position.

The method of generating a pulse sequence in pulse sequence generating section 123 will be explained in detail using FIG. 7(A) to FIG. 7(C).

Figure 7:
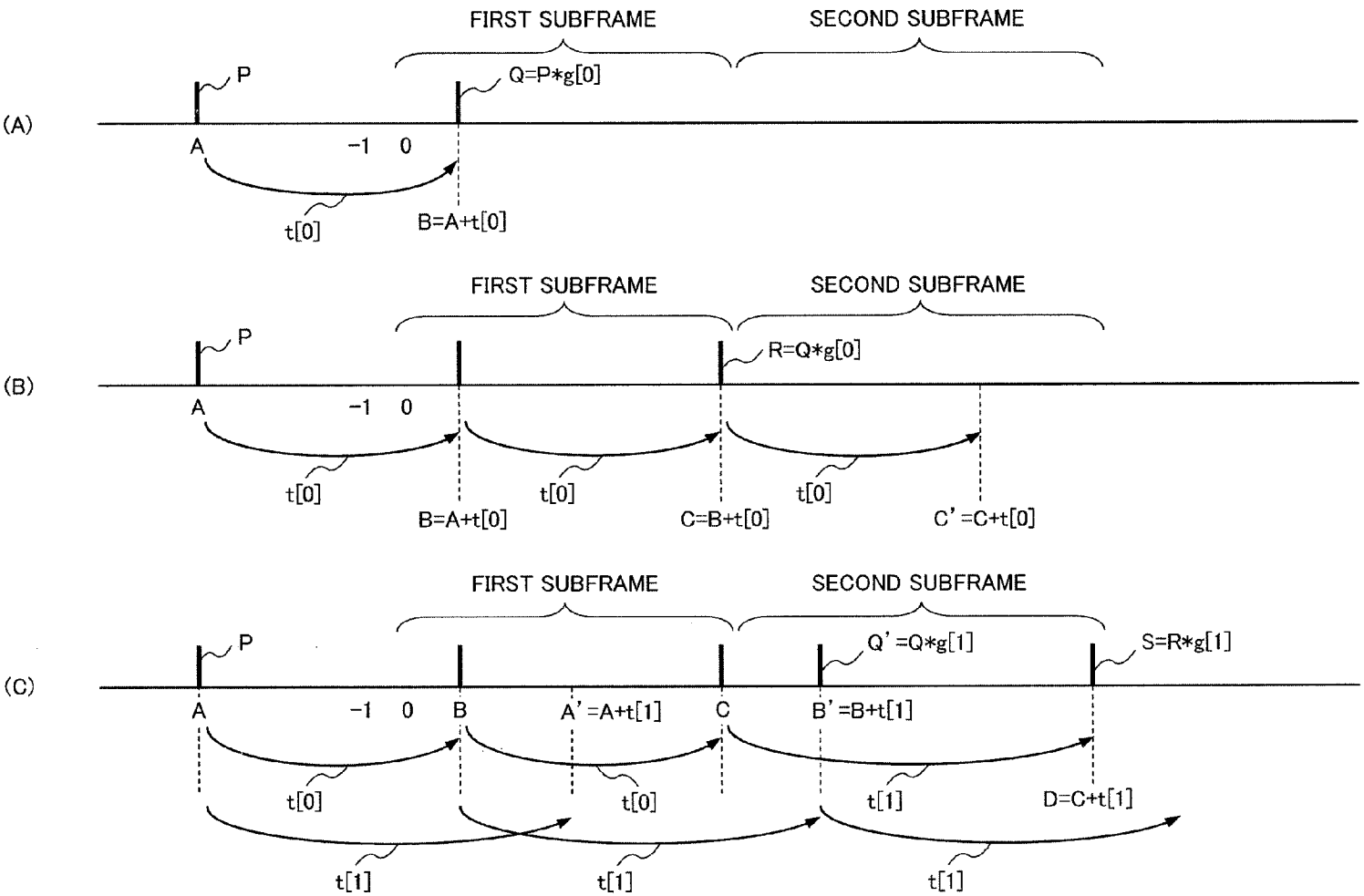
FIG. 7 is a diagram illustrating a pulse sequence generating method according to an embodiment of the present invention.

As shown in FIG. 7(A), when a pitch pulse position candidate received as input from pitch pulse candidate selecting section 122 via changeover switch 125 is "A," first, a pulse of amplitude P (=1) is placed in A.

Next, based on the above-noted pulse (position A, amplitude P), a pulse is placed in the first subframe. First, whether or not position B (=A+t[0]), which is t[0] (i.e. pitch period in the first subframe) after position A, is within the first subframe, is decided. In the example of FIG. 7(A), position B is within the first subframe, and therefore a pulse of amplitude Q (=P*g[0]) is placed in position B.

Next, whether or not position C (=B+t[0]), which is t[0] after position B, is within the first subframe, is decided. In the example of FIG. 7(B), position C is still within the first subframe, and therefore a pulse of amplitude R (=Q*g[0]) is placed in position C. Further, whether or not position C' (=C+t[0]), which is t[0] after position C, is within the first subframe, is decided. In the example of FIG. 7(B), position C' is outside the first subframe, and it is therefore decided that all pulses that can be placed in the first subframe are placed. Then, the flow proceeds to pulse generation in the second subframe.

Pulse generation in the second subframe is performed by adding the pitch period of the second subframe, which is t[1], to the positions of all pulses placed in the first subframe, and by deciding whether or not the positions represented by the addition results are within the second subframe.

That is, in the example of FIG. 7(C), position A', adding t[1] to position A, is not within the second subframe, and therefore a pulse is not placed in position A'. On the other hand, position B', adding t[1] to position B, is within the second subframe, and therefore a pulse of amplitude Q' (=Q*g[1]) is placed in position B'. Also, position D', adding t[1] to position C, is within the second subframe, and therefore a pulse of amplitude S (=R*g[1]) is placed in position D. Then, the position adding t[1] to position B', which is next to position C, is outside the second subframe, and therefore pulse generation in the second subframe is finished.

Figure 8:
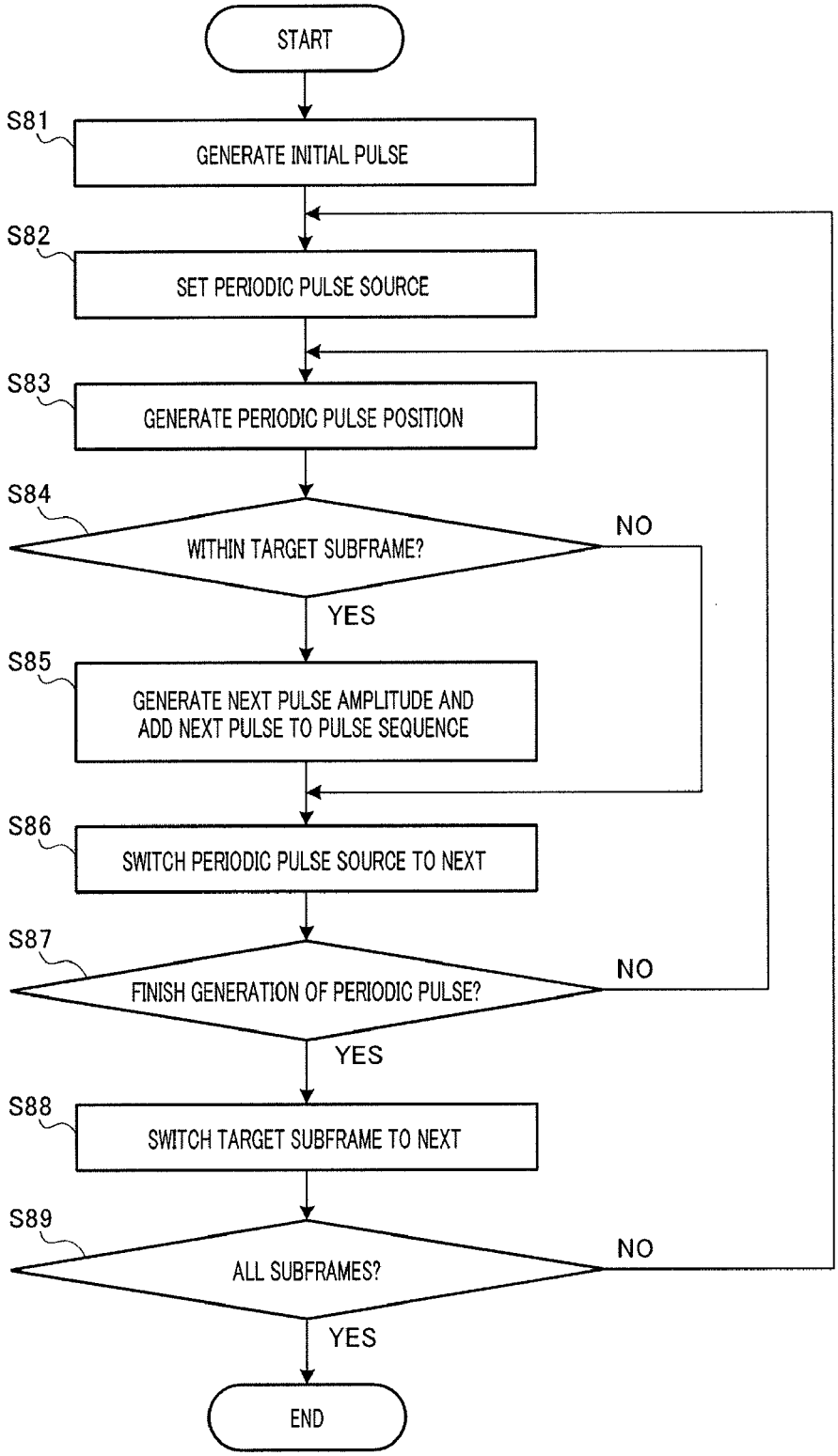
FIG. 8 is a flowchart showing the generating steps of a pulse sequence according to an embodiment of the present invention.

That is, pulse sequence generation with respect to each pitch pulse position candidate will be performed according to the processing flow shown in FIG. 8.

First, in step S81, an initial pulse of amplitude "1" is placed in a pitch pulse position candidate received as input (i.e. initial pulse generation).

Next, in step S82, a pulse, which was already placed, is set as the periodic pulse source. For example, in pulses which were already placed, the earliest pulse is set as the periodic pulse source.

Next, in step S83, the position of the next pulse (hereinafter "periodic pulse") is generated using the pitch period of the target subframe. That is, the position acquired by adding the pitch period of the target subframe to the position of the periodic pulse source, is set as the position of the periodic pulse.

Here, the pitch period may be decimal precision. In the case of decimal precision, although the position of a generated periodic pulse may not be an integer, in this case, the position of the periodic pulse is set as integer precision by rounding off a number after the decimal point, and so on. By this means, it is possible to assure the sparse characteristic of a pulse sequence and suppress an increase of the computational complexity in the subsequent error calculations. However, if a pulse position after the integer precision as above is recursively used, error in a later time position becomes large. Therefore, in a range in which a pulse position is recursively used, a pitch period of decimal precision is used as is to find a position of the periodic pulse. By this means, it is possible to prevent pulse position error from being accumulated.

Next, in step S84, whether or not the position of the periodic pulse is within the target subframe is decided.

If the position of the periodic pulse is within the target subframe ("YES" in step S84), in step S85, the amplitude of the next pulse (i.e. the periodic pulse decided to be present in the target subframe) is found (i.e. amplitude generation), and the next pulse having the amplitude is generated and placed in the position of the periodic pulse. That is, a pulse decided to be present in the target subframe is added to a pulse sequence (i.e. a set of periodic pulse source pulses). The flow then proceeds to step S86.

By contrast, if the position of the periodic pulse is outside the target subframe ("NO" in step S84), the flow proceeds to step S86 without generating a periodic pulse.

In step S86, a periodic pulse source is switched to the next. That is, in the pulse sequence including the periodic pulse acquired in step S83, the position of the next earlier pulse in the time domain than the pulse, which was the periodic pulse source heretofore, is made the position of a new periodic pulse source.

Next, in step S87, whether or not all periodic pulses that can be generated in the target subframe using the pitch period of the target subframe, were generated is decided. That is, whether or not periodic pulse generation in the target subframe is finished, is decided. If the position of the periodic pulse source is outside the target subframe, it is assumed that periodic pulse generation in the target subframe is finished. Here, when the upper limit value of the number of pulses is set in advance on a per subframe basis and the number of periodic pulses generated in the target subframe reaches the upper limit value, it may be assumed that periodic pulse generation in that target subframe is finished. By this means, it is possible to set the upper limit of the computational complexity for pulse sequence generation. Also, step S87 may be provided immediately after step S81.

If periodic pulse generation in the target subframe is finished ("YES" in step S87), in step S88, the target subframe is switched to the next.

By contrast, if periodic pulse generation in the target subframe is not finished ("NO" in step S87), the flow returns to step S83.

Next, in step S89, whether or not pulse generation in all subframes is finished, is decided.

Then, if pulse generation in all subframes is finished ("YES" in step S89), pulse sequence generation is finished.

By contrast, if pulse generation in all subframes is not finished ("NO" in step S89), the flow returns to step S82, the periodic pulse source is made the head pulse of a pulse sequence which was already generated (i.e. the temporally earliest pulse), and pulse sequence generation, targeting the next subframe, is performed in the same way as above.

Error minimizing section 124 receives as input the pulse sequence of each pitch pulse position candidate generated as above in pulse sequence generating section 123.

Error minimizing section 124 decides whether or not the square error between the decoded excitation vector and the vector multiplying the pulse sequence vector by the optimal gain, is minimum. To be more specific, error minimizing section 124 decides whether or not the square error in the pitch pulse position candidate currently received as input, is less than the minimum square error in a pitch pulse position candidate received as input in the past. If the pulse sequence vector in the pitch pulse position candidate currently received as input is the pulse sequence vector that produces the minimum square error heretofore, error minimizing section 124 stores the pitch pulse position candidate and its pulse sequence vector. Error minimizing section 124 performs the above-described processing for all pitch pulse position candidates, while sequentially giving switch commands to changeover switch 125. Then, error minimizing section 124 outputs, as a pitch pulse position, the pitch pulse position candidate stored when the above-described processing for all pitch pulse position candidates is finished, and outputs the ideal gain for the pulse sequence vector stored at that time, as a pitch pulse amplitude. Here, error minimizing section 124 may acquire minimum square error using an evaluation criterion to compare quantities of square errors.

Thus, according to the present embodiment, selection of search start point candidates is performed based on error in the previous frame. Further, selection of the definitive pitch pulse position is performed based on the error between the pitch pulse placed in the previous frame and an excitation signal, and the error between the pulse sequence placed in the current frame and the excitation signal, that is, a pitch pulse is searched for taking into account both the previous frame and the current frame. Therefore, it is possible to detect a pitch pulse that is optimal to conceal an erased frame, that is, it is possible to detect a pitch pulse that is effective for both an erased frame and the subsequent frame. By this means, the speech decoding apparatus can acquire a decoded speech signal of high quality even if an erased frame occurs.

Further, according to the present embodiment, the speech encoding apparatus transmits the current encoded frame (n) including redundant information for erasure concealment processing with respect to the encoded frame (n−1) of the previous frame, thereby encoding redundant information for erasure concealment processing without causing algorithm delay. By this means, if the speech decoding apparatus does not use information for high-quality erasure concealment, it is possible to shorten the overall algorithm delay of the decoding processing by one frame.

Further, the present embodiment transmits redundant information for erasure concealment processing with respect to encoded frame (n−1) of the previous frame, with the current encoded frame (n). Therefore, it is possible to decide whether or not a frame assumed to be erased is an important frame such as an onset frame, using temporally future information, thereby improving the decision accuracy.

An embodiment of the present invention has been described above.

The speech encoding apparatus and speech decoding apparatus according to the present invention can be mounted on a radio communication mobile station apparatus and radio communication base station apparatus in a mobile communication system, so that it is possible to provide a radio communication mobile station apparatus, radio communication base station apparatus and mobile communication system having the same operational effect as above.

Although a case has been described with the above embodiment as an example where the present invention is implemented with hardware, the present invention can be implemented with software. For example, by describing the algorithm of the speech encoding method according to the present invention in a programming language, storing this program in a memory and making the information processing section execute this program, it is possible to implement the same function as the speech encoding apparatus according to the present invention.

Furthermore, each function block employed in the description of each of the aforementioned embodiments may typically be implemented as an LSI constituted by an integrated circuit. These may be individual chips or partially or totally contained on a single chip. "LSI" is adopted here but this may also be referred to as "IC," "system LSI," "super LSI," or "ultra LSI" depending on differing extents of integration.

Further, the method of circuit integration is not limited to LSI's, and implementation using dedicated circuitry or general purpose processors is also possible. After LSI manufacture, utilization of an FPGA (Field Programmable Gate Array) or a reconfigurable processor where connections and settings of circuit cells in an LSI can be reconfigured is also possible.

Further, if integrated circuit technology comes out to replace LSI's as a result of the advancement of semiconductor technology or a derivative other technology, it is naturally also possible to carry out function block integration using this technology. Application of biotechnology is also possible.

The disclosure of Japanese Patent Application No. 2007-053530, filed on Mar. 2, 2007, including the specification, drawings and abstract is incorporated herein by reference in its entirety.

INDUSTRIAL APPLICABILITY

The speech encoding apparatus and speech encoding method according to the present invention are applicable to a radio communication mobile station apparatus, radio communication base station apparatus, and so on, in a mobile communication system.

The invention claimed is:

1. A speech encoding apparatus using pitch pulse information as redundant information for erasure concealment processing, the apparatus comprising:

a determination processor that determines a search range of a pitch pulse position in a previous frame, using a pitch period of a current frame;

a selection processor that selects a plurality of candidates of the pitch pulse position using an excitation signal of the previous frame;

a generation processor that generates an adaptive codebook component of an excitation signal in the current frame using the plurality of candidates; and an error minimization processor that acquires a definitive pitch pulse position in the previous frame by minimizing an error between a vector of the adaptive codebook component and an error-free decoded excitation vector.

2. The speech encoding apparatus according to claim 1, wherein the determining section determines, as a start point of the search range, the earliest position among a plurality of positions respective pitch periods in a plurality of subframes included in the current frame back from heads of the plurality of subframes.

3. The speech encoding apparatus according to claim 1, wherein the selecting section divides a plurality of pitch pulse positions in the search range into a plurality of groups, and selects a position, in which an amplitude of an excitation signal is the highest, in each of the plurality of groups as the plurality of candidates.

4. The speech encoding apparatus according to claim 1, wherein the generating section generates the adaptive codebook component by generating a pulse sequence using the pitch period and a pitch gain of the current frame.

5. The speech encoding apparatus according to claim 4, wherein the generating section generates the pulse sequence comprising a predetermined upper limit number of pulses.

6. A radio communication mobile station apparatus comprising the speech encoding apparatus according to claim 1.

7. A radio communication base station apparatus comprising the speech encoding apparatus according to claim 1.

8. A speech encoding method using pitch pulse information as redundant information for erasure concealment processing, the method comprising:

determining a search range of a pitch pulse position in a previous frame, using a pitch period of a current frame;

selecting a plurality of candidates of the pitch pulse position using an excitation signal of the previous frame;

generating an adaptive codebook component of an excitation signal in the current frame using the plurality of candidates; and acquiring a definitive pitch pulse position in the previous frame by minimizing an error between a vector of the adaptive codebook component and an error-free decoded excitation vector.

* * * * *

UNITED STATES PATENT AND TRADEMARK OFFICE

CERTIFICATE OF CORRECTION

PATENT NO. : 8,364,472 B2
APPLICATION NO. : 12/528880
DATED : January 29, 2013
INVENTOR(S) : Hiroyuki Ehara It is certified that error appears in the above-identified patent and that said Letters Patent is hereby corrected as shown below:

On the Title Page, at Item (75) Inventors, "Hiroyuki Ehara, Kangawa (JP)" should be changed to -- Hiroyuki Ehara, Kanagawa (JP) --.

Signed and Sealed this
Fourth Day of June, 2013

Teresa Stanek Rea
*Acting Director of the United States Patent and Trademark Office*